US005122230A

United States Patent [19]

Nakajima

[11] Patent Number: 5,122,230

[45] Date of Patent: Jun. 16, 1992

[54] PROCESS FOR MODIFYING HYDROPHILIC FIBERS WITH SUBSTANTIALLY WATER-INSOLUBLE INORGANIC SUBSTANCE

[75] Inventor: Keihachiro Nakajima, Tokyo, Japan

[73] Assignee: Oji Paper Co., Ltd., Tokyo, Japan

[21] Appl. No.: 699,071

[22] Filed: May 13, 1991

[30] Foreign Application Priority Data

May 14, 1990 [JP] Japan ..... 2-121221
Jun. 22, 1990 [JP] Japan ..... 2-162946

[51] Int. Cl.[5] ..... D21H 17/67

[52] U.S. Cl. ..... 162/157.1; 162/157.2; 162/157.3; 162/157.4; 162/181.1; 162/181.2; 162/181.3; 162/181.6; 162/181.7; 162/182

[58] Field of Search ..... 162/9, 181.1, 181.2, 162/181.3, 181.4, 181.5, 181.6, 181.7, 182, 183, 157.2, 157.3, 146, 157.1, 157.4; 264/83, 129

[56] References Cited

U.S. PATENT DOCUMENTS

| | | | |
|---|---|---|---|
| 113,454 | 4/1871 | Schmidt | 162/181.2 |
| 670,511 | 3/1901 | Friese-Greene | 162/181.2 |
| 2,399,982 | 5/1946 | Britt | 162/181.7 |
| 2,583,548 | 1/1952 | Craig | 162/181.2 |
| 2,599,091 | 6/1952 | Craig | 162/181.2 |
| 2,599,093 | 6/1952 | Craig | 162/181.2 |
| 2,599,094 | 6/1952 | Craig | 162/181.2 |
| 2,709,653 | 5/1955 | Marshall et al. | 162/181.2 |
| 2,823,997 | 2/1958 | Craig | 162/181.2 |
| 3,029,181 | 4/1962 | Thomsen | 162/181.1 |
| 3,044,924 | 7/1962 | Schur | 162/181.5 |

FOREIGN PATENT DOCUMENTS

| | | | |
|---|---|---|---|
| 62-162098 | 7/1987 | Japan | 162/181.2 |
| 62-199898 | 9/1987 | Japan | 162/181.2 |
| 726803 | 3/1955 | United Kingdom | 162/181.2 |

*Primary Examiner*—Peter Chin
*Attorney, Agent, or Firm*—Armstrong, Nikaido, Marmelstein, Kubovcik & Murray

[57] ABSTRACT

A hydrophilic fibers modified with a substantially water-insoluble inorganic compound is produced by immersing hydrophilic fibers, for example, pulp fibers, in an aqueous solution of a water-soluble inorganic compound (a) which is precipitated when brought into contact with a precipitant (b), adjusting the amount of the aqueous solution impregnated in the hydrophilic fibers to 60 to 400% based on the weight of the hydrophilic fibers, and bringing the hydrophilic fibers with the aqueous solution of the inorganic compound (a) into contact with the precipitant in the state of a gas or aqueous solution to thereby cause the resultant substantially water-insoluble compound to be precipitated in and fixed to the hydrophilic fibers.

12 Claims, No Drawings

PROCESS FOR MODIFYING HYDROPHILIC FIBERS WITH SUBSTANTIALLY WATER-INSOLUBLE INORGANIC SUBSTANCE

BACKGROUND OF THE INVENTION

1) Field of the Invention

The present invention relates to a process for producing hydrophilic fibers with a water-insoluble inorganic substance. More particularly, the present invention relates to a process for producing hydrophilic fibers modified with a substantially water-insoluble inorganic substance, for example, a substantially water-insoluble metal hydroxide, precipitated in and fixed to bores, pores and surfaces of the hydrophilic fibers, to provide modified hydrophilic fibers useful as a paper-forming material, a shaped article-forming material, and other functional materials in which the specific functions of the substantially water-insoluble inorganic substance carried by the hydrophilic fibers are utilized.

2) Description of the Related Art

Various processes for producing hydrophilic fibers, for example, paper-forming pulp fibers, modified with a substantially water-insoluble hydroxide, for example, aluminum hydroxide, are known from Japanese Examined Patent Publication No. 56-18,712, which discloses a process wherein fine particles of aluminum hydroxide are adhered to surfaces of a paper sheet by a coating method; from Japanese Unexamined Patent Publication No. 57-144,754, which discloses a process wherein a paper sheet containing 70% by weight or more of aluminum hydroxide is formed from a pulp slurry containing an aluminum hydroxide powder; and from Japanese Unexamined Patent Publication No. 57-171,799, which discloses a process wherein a paper sheet containing 50 to 95% by weight of aluminum hydroxide is produced from a pulp slurry containing an aluminum hydroxide powder together with a sizing agent and binder.

In these conventional processes, the substantially water-insoluble inorganic substance are adhered in the form of fine particles to a surface of a paper sheet, or mixed in the form of fine particles to provide a pulp slurry, but a water-soluble inorganic compound is not utilized to provide the substantially water-insoluble inorganic substance.

As conventional methods wherein a water-soluble inorganic substance, for example sodium aluminate, is utilized for paper-making, Chizhov, G. I. et al., Mezhvuz, Sb. Mauch. Tr., Khimiya Tekhnol. Tsellyulozy, No. 8, 67–70 (1981) discloses a use of sodium aluminate mixed to a pulp, to enhance a mechanical strength of the resultant paper sheet; U.S. Pat. No. 3,706,629 discloses an addition of a polymeric electrolyte and an aluminate of an alkali metal to a pulp, to improve the dehydration property and retention of the pulp in the paper-forming step; and Canadian Patent No. 964,808 teaches an addition of a water-soluble aluminum salt and sodium aluminate to a pulp.

Nevertheless, these conventional methods do not teach a conversion of a water-soluble inorganic compound to a substantially water-insoluble inorganic substance on or within a hydrophilic fibers.

Lagally, P. and Lagally, H., Tappi, 42 (11), 888 (1959) teach a method of precipitating a gel-like aluminum hydroxide on pulp fibers by immersing the pulp fibers in an aqueous solution of sodium aluminate and neutralizing the sodium aluminate aqueous solution with a mineral acid, but this method is disadvantageous in that, since the mineral acid is added to the pulp slurry containing sodium aluminate, a major portion of the resultant gel-like aluminum hydroxide remains in the pulp slurry but not in and on the pulp fibers, and thus the utilization efficiency of the resultant aluminum hydroxide for the pulp fibers is poor.

This method is intended to increase the mechanical strength of the resultant paper sheet by the combination of the gel-like aluminum hydroxide with the cellulose pulp fibers, but the amount of the gel-like aluminum hydroxide picked up by the pulp fibers is relatively small, and thus the increase in the mechanical strength of the resultant paper sheet is unsatisfactory.

A method similar to that mentioned above is disclosed by Hechler E., Wochenblatt für Papierfabrikation, 96 (23/24), 868 (1968). In this method, a beaten pulp slurry is supplemented with sodium aluminate in an amount of 5% based on the weight of the pulp, and then brought into contact with carbon dioxide, aluminum sulfate or calcium carbonate, to convert the sodium aluminate in the pulp slurry to aluminum hydroxide and thereby provide a filler-containing pulp usable for paper-formation.

This method, however, is disadvantageous in that the effective utilization efficiency of the resultant aluminum hydroxide is unsatisfactory.

Further, J.G., Soluble SillicaatesACS Monograph Series, Reinhold, N. Y., Vol. 2, 333 (1952) discloses a method in which sodium silicate (soluble glass) is added to a pulp slurry and the pH of the resultant sodium silicate-containing pulp slurry is lowered, to cause the resultant silicic acid gel to be precipitated. The purpose of this method is to size the resultant paper sheet with the silicic acid gel, and therefore, the amount of the silicic acid gel picked up by the pulp fibers must be relatively small.

Cray, W. L., Pulp and Paper Magazine of Canada, August, 116 (1955) discloses a process in which a pulp slurry is supplemented with calcium chloride and then with sodium silicate to produce calcium silicate in the pulp slurry, and thereafter, aluminum sulfate is added to the pulp slurry to cause the resultant calcium sulfate to be precipitated in the pulp fibers in the slurry.

This process, however, is not suitable for causing a large amount of a water-insoluble inorganic substance to be carried on the pulp fibers.

Japanese Unexamined Patent Publication No. 62-144,901 discloses a process in which two different types of water-soluble inorganic compound aqueous solutions, which form a water-insoluble and flame-resistant inorganic compound when mixed together, for example, an aqueous solution of barium chloride and boric acid and an aqueous solution of hydrogen ammonium phosphate and boric acid, is proposed; a wood material is immersed in one of the above-mentioned aqueous solutions and then in the other aqueous solution, to cause the resultant water-insoluble and flame resistant inorganic compound to be dispersed and carried in the wood material. This method effectively produces a flame-resistant wood material, but is not suitable for modifying a hydrophilic fibrous material usable for paper.

Accordingly, it is not as yet known how to impart and fix a large amount of a substantially water-insoluble inorganic substance to hydrophilic fibers, for example, paper-forming pulp fibers.

SUMMARY OF THE INVENTION

An object of the present invention is to provide a process for modifying hydrophilic fibers with a substantially water-insoluble inorganic substance, in a large amount and at a high efficiency.

Another object of the present invention is to provide a process for modifying hydrophilic fibers with a substantially water-insoluble inorganic substance in a large amount, to thereby provide modified hydrophilic fibers having an enhanced flame resistance, dimensional stability, heat resistance, opacity, and/or hydroscopicity and useful for paper sheets, shaped articles and functional materials.

The above-mentioned objects can be attained by the process of the present invention for modifying hydrophilic organic fibers with a substantially water-insoluble inorganic substance, which comprises the steps of, immersing hydrophilic fibers in an aqueous solution comprising 6 to 60% by weight of a water-soluble inorganic compound (a) which is converted to a substantially water-insoluble inorganic compound when brought into contact with a precipitant (b); adjusting the amount of the water-soluble inorganic compound (a) aqueous solution impregnated in the hydrophilic fibers to a level of 60 to 400% based on the dry weight of the hydrophilic fibers; and bringing the impregnated hydrophilic fibers into contact with the precipitant (b), in the state of a gas, to cause the resultant substantially water-insoluble inorganic compound to be precipitated in and fixed to the hydrophilic fibers.

DESCRIPTION OF THE PREFERRED EMBODIMENTS

The hydrophilic fibers usable for the process of the present invention are not limited to a specific type of fibers, and can be selected from among known hydrophilic synthetic fibers; for example, polyvinylalcohol fibers and polyacrylamide fibers, and from hydrophilic natural fibers; for example, lignocellulosic fibers.

The hydrophilic fibers are preferably lignocellulosic fibers, especially lignocellulosic pulp fibers for paper.

The lignocellulosic fibers may be those derived from wood materials or herbaceous plants.

The pulp fibers usable for the process of the present invention may be those produced by any type of pulping methods and treated by any type of procedures, for example, bleaching, beating, and dyeing, and by a chemical treatment.

In the first step of the process of the present invention, the hydrophilic fibers are immersed in an aqueous solution of a water-soluble inorganic compound (a) capable of being converted to a substantially water-insoluble inorganic compound when brought into contact with a precipitant (b).

In the immersing step, the water-soluble inorganic compound (a) is preferably present in a relatively high concentration of 6 to 60% by weight, more preferably 10 to 40% by weight, in the aqueous solution thereof, to cause a large amount of the inorganic compound (a) to be impregnated in the hydrophilic fibers.

Some of the high concentration aqueous solution of the inorganic compound (a), for example, alkali aluminate, can swell the cellulosic fibers, but this effect is unsatisfactory when the concentration of the inorganic compound (a) is less than 6% by weight.

The concentration of the inorganic compound (a) in the aqueous solution influences the amount of the substantially water-insoluble inorganic compound impregnated in the hydrophilic fibers. Namely, the higher the concentration of the inorganic compound (a), the larger the amount of the resultant substantially water-insoluble inorganic compound fixed to the hydrophilic fibers.

The immersing step can be carried out at any temperature between the freezing point and the boiling point of the aqueous solution of the inorganic compound (a).

Also, there is no restriction of the time for which the hydrophilic fibers are immersed in the aqueous solution of the inorganic compound (a).

In the second step of the process of the present invention, the amount of the aqueous solution of the inorganic compound (a) impregnated in the hydrophilic fibers is adjusted to a level of 60 to 400% based on the dry weight of the hydrophilic fibers.

In the adjusted hydrophilic organic fibers impregnated with the aqueous solution of the water-soluble inorganic compound (a), the dry content of the fibers is preferably 30% by weight or more.

The amount of the inorganic compound (a) aqueous solution picked up by the hydrophilic fibers governs the amount of the resultant substantially water-insoluble inorganic compound fixed to the hydrophilic fibers. Namely, the larger the amount of the inorganic compound (a) aqueous solution picked up by the hydrophilic fibers, the larger the amount of the resultant substantially water-insoluble inorganic compound fixed to the hydrophilic fibers.

The adjustment of the amount of the inorganic compound (a) aqueous solution picked up by the hydrophilic fibers can be effected by any one of the conventional procedures; for example, squeezing, gravitative dehydration on a net, suction dehydration, centrifugalizing, and pressing.

By removing an excessive amount of the inorganic compound (a) aqueous solution from the immersed hydrophilic fibers, almost all of the aqueous solution located on the surfaces of the hydrophilic fibers can be removed, so that almost all of the picked up aqueous solution is located inside of the hydrophilic fibers (for paper-forming wood pulp fibers, on the cell walls in the fibers) and in the resultant modified hydrophilic fibers, the resultant substantially water-insoluble inorganic compound is located mainly inside of the fibers. When the amount of the inorganic compound (a) aqueous solution picked up by the hydrophilic fibers is less than 60%, the amount of the resultant substantially water-insoluble inorganic compound fixed to the hydrophilic fibers becomes too low, and the property of the resultant modified fibers becomes unsatisfactory.

Also, if the amount of the inorganic compound (a) aqueous solution is more than 400%, a large amount of the substantially water-insoluble inorganic compound is formed on the surfaces of the hydrophilic fibers. The substantially water-insoluble inorganic compound on the fiber surfaces is easily removed, and therefore, the efficiency of modifying the imported substantially water-insoluble inorganic compound for the hydrophilic fibers becomes poor.

In the third step of the process of the present invention, the impregnated hydrophilic fibers are brought into contact with the precipitant (b), to thereby cause the resultant substantially water-insoluble inorganic compound to be precipitated in and fixed to the hydrophilic fibers.

In an embodiment of the process of the present invention, the water-soluble inorganic compound (a) is selected from aluminates, silicates and zincates of alkali metals, and the precipitant (b) comprises at least one acidic compound selected from carbon dioxide and hydrogen chloride in the state of a gas. In this embodiment, at least one member selected from hydroxides and oxides of aluminum, zinc and silicon is precipitated as a substantially water-insoluble inorganic compound.

In another embodiment, an alkaline earth metal hydroxide, which is not completely soluble in water, is used as a water-soluble inorganic compound (b). When dispersed in water, a portion of the alkaline earth metal hydroxide is dissolved in water, and can be precipitated upon reacting with carbon dioxide gas to form a water-insoluble alkalin earth metal carbonate.

In still another embodiment of the process of the present invention, the water-soluble inorganic compound is selected from silver nitrate, lead nitrate, mercurous nitrate, copper nitrate, and tin (II or IV) nitrate, and the precipitant (b) comprises a halogen in the state of a gas. In these embodiments, the above-mentioned water-soluble nitrates are respectively converted to water insoluble silver halide, lead halide and mercurous halide.

In still another embodiment of the process of the present invention, the water-soluble inorganic compound (a) is selected from water soluble salts of aluminum, chromium (III), zinc, manganese, iron (II or III), nickel, and cobalt, and the precipitant (b) comprises hydrogen sulfide in the state of a gas. In this embodiment, the water-soluble salts are preferably nitrates of the above-mentioned metals and are converted to water-insoluble sulfides of the metals.

In still another embodiment of the process of the present invention, the aqueous solution of the water-soluble inorganic compound (a) contains at least one member selected from water-soluble salts, for example, nitrates, of alkaline earth metals, together with at least one member selected from ammonia and alkali metal carbonates and the precipitant (b) comprises carbon dioxide in the state of a gas. In this embodiment, the water-soluble salts of the alkaline earth metals are converted to corresponding water-insoluble carbonates of the alkaline earth metals.

In still another embodiment of the process of the present invention, the water-soluble inorganic compound (a) is selected from water-soluble salts of metallic elements other than alkali metals together with at least one member selected from ammonia and alkali metal carbonates, and the precipitant (b) comprises ammonia in the state of a gas. The water-soluble salts of the metallic elements other than alkali metals are preferably selected from water-soluble nitrates, chlorides and sulfates of silver, zinc, aluminum, cobalt, zirconium, tin, titanium, iron, copper, lead, magnesium, cadmium, mercury and chromium. In this embodiment, the above-mentioned water-soluble salts are converted to corresponding water-insoluble hydroxides, oxides or complexes.

For example, silver nitrate is reacted with ammonia and converted to water insoluble silver oxide; mercury nitrate is reacted with ammonia and converted to water-insoluble complex of the formula: $OHg_2NH_2NO_3$; a reaction of copper sulfate with ammonia results in the production of water insoluble compound of the formula: $Cu_2(OH)_2SO_4$; and further, a reaction of mercury chloride with ammonia results in the production of water-insoluble compound of the formula: $Hg(NH_2)Cl$. In this embodiment, the preferable water-soluble inorganic compounds (a) are water-soluble aluminum salts, for example, aluminum chloride, aluminum sulfate and aluminum nitrate, which can be reacted with ammonia to produce water-insoluble aluminum hydroxide.

When the precipitant (b) is in the state of a gas, the hydrophilic fibers impregnated with the aqueous solution of the water-soluble inorganic compound (a) are preferably opened in the ambient air atmosphere before being brought into contact with the precipitant gas (b), to promote the contact of the water-soluble inorganic compound (a) picked up by the hydrophilic fibers with the gaseous precipitant (b).

The gaseous precipitant (b) may be diluted by a gas non-reactive to the water-soluble inorganic compound (b), for example, a nitrogen gas or air. In the diluted gas, the concentration of the gaseous precipitant (b) is preferably 0.03% by volume or more.

In the process of the present invention, the pressure of the precipitant-containing gas is not specifically limited, and is preferably the atmospheric pressure or more but not more than 10 $kg/cm^2$ G.

There is no restriction of the time of contact of the impregnated hydrophilic fibers with the gaseous precipitant (b), but preferably, the contact time is from 10 minutes to 5 hours.

In still another embodiment of the process of the present invention, the water-soluble inorganic compound (a) is selected from water soluble alkaline earth metal salts, and the precipitant (b) comprises an aqueous solution containing at least one member selected from fluorine, phosphate, carbonate, sulfate, borate and chromate ions. In this embodiment, the alkaline earth metal salts are preferably selected from magnesium, calcium and barium.

These salts can be converted to corresponding water-insoluble fluorides, phosphates, carbonates, sulfates, borates and chromates.

In still another embodiment of the process of the present invention, the water-soluble inorganic compound (a) is selected from aluminates, silicates and zincates of alkali metals, and the precipitant (b) comprises an aqueous solution containing a mineral acid, for example, hydrochloric acid and sulfuric acid, capable of converting the above-mentioned water-soluble compounds to substantially water-insoluble compounds, for example, hydroxides or oxides, of aluminum, silicon and zinc.

In still another embodiment of the process of the present invention, the water-soluble inorganic compound (a) is selected from water-soluble salts of metallic elements other than alkali metals, and the precipitant (b) comprises an aqueous solution of ammonia. The above-mentioned water-soluble salts are preferably selected from nitrates, chlorides, and sulfates of zinc, aluminum, cobalt, zirconium, tin, titanium, iron, copper, lead, magnesium, cadmium, mercury and chromium. These specific water-soluble salts are converted to corresponding substantially water-insoluble hydroxides, upon reacting with ammonia.

The aqueous solution of the precipitant (b) can be prepared by dissolving the precipitant (b) in water. Also, in the third step of the process of the present invention, the impregnated hydrophilic fibers with the water-soluble inorganic compound (a) aqueous solution are continuously introduced into the aqueous solution of the precipitant (b), while blowing the precipitant (b) in the state of a gas into the aqueous solution.

There is no restriction of the temperature of the precipitant aqueous solution, as long as the temperature is in the range of from the freezing point and the boiling point of the aqueous solution. Also, there is no limitation on the time of contact of the impregnated hydrophilic fibers with the precipitant aqueous solution.

The process of the present invention is useful for easily producing hydrophilic fibers carrying therein a large amount of water-insoluble inorganic compound, at a low cost and high efficiency.

By utilizing the process of the present invention, a large amount of the water-insoluble inorganic compound can be precipitated not only on the surface but also inside of the hydrophilic fibers, and the resultant modified hydrophilic fibers exhibit a specific function, for example, an enhanced flame resistance, derived from the water-insoluble inorganic compound fixed to the fibers.

EXAMPLES

The present invention will be further illustrated by the following specific examples.

Example 1

An unbeaten, bleached soft wood kraft pulp in an amount of 3.0 g was immersed in 200 ml of a solution of 30% by weight of sodium aluminate in an ion-exchanged water at room temperature for 3 hours. Thereafter, the immersed pulp was removed from the aqueous solution of sodium aluminate, sucked by a Buchner funnel, and then centrifugalized at an acceleration of gravity of 900 g for 3 minutes. The resultant pulp impregnated with the sodium aluminate aqueous solution had a weight of 15 g.

The impregnated pulp was opened in the ambient air atmosphere by using a mixer, and the opened pulp was placed in a pressure container, and thereafter, the container was closed and filled with a carbon dioxide gas under a pressure of 1 kg/cm$^2$ G. The opened pulp was left to stand in the container under the above-mentioned condition for 10 minutes. After the carbon dioxide gas was discharged from the container, the resultant pulp was removed from the container, immersed in one liter of ion-exchanged water at room temperature for one hour, disintegrated in water by using a disintegrator, washed with water on a 150 mesh wire net, and then dried.

The resultant modified pulp had the same appearance as non-modified pulp and was composed of individual pulp fibers which were separated from each other.

The modified pulp was then incinerated at a temperature of 900° C., to determine the amount of aluminum hydroxide carried in and fixed to the pulp fibers, and as a result, it was confirmed that the amount of the fixed aluminum hydroxide was 43%, based on the dry weight of the pulp fibers.

Example 2 and Comparative Example 1

In Example 2, a beached hard wood kraft pulp beaten to a Canadian standard freeness of 350 ml in an amount of 3.0 g was immersed in 200 ml of a solution of 30% by weight of sodium aluminate in an ion-exchanged water at room temperature for 3 hours.

The immersed pulp was removed from the sodium aluminate aqueous solution, sucked by a Buchner funnel, and then centrifugalized under an acceleration of gravity of 3000 g for 15 minutes. The centrifugalized pulp had a weight of 10 g.

The pulp was opened in the ambient air atmosphere by using a mixer, and the opened pulp was placed in a treatment vessel.

A carbon dioxide gas was then flowed through the treatment vessel at a flow rate of 500 ml/min under the ambient air atmospheric pressure, and this treatment was continued for 10 minutes. Thereafter, the carbon dioxide gas was discharged from the vessel, and the resultant modified pulp was removed from the vessel, immersed in one liter of ion-exchanged water at room temperature for one hour, opened in water by using a fiber opener, washed with water on a 150 mesh wire net, and then dried.

The resultant modified pulp was then incinerated at a temperature of 900° C., and as a result, it was confirmed that the amount of aluminum hydroxide carried in the pulp fibers was 32%, based on the dry weight of the pulp.

Also, the pulp fibers were observed by a microscope, and as a result, it was confirmed that almost all of the aluminum hydroxide imparted to the pulp fibers was located inside of the pulp fibers, and that substantially no aluminum hydroxide was located on the surface and in the lumen of the pulp fibers.

The modified pulp (A) was converted to a paper sheet having a basis weight of 100 g/m$^2$, by a customary paper forming process.

In Comparative Example 1, a paper sheet (B) with a basis weight of 100 g/m$^2$ was produced from an aqueous slurry of a mixture of the same non-modified pulp as used in Example 2, with aluminum hydroxide dispersed therein.

The amount of the aluminum hydroxide contained in the paper sheet (B) is the same as that contained in the paper sheet (A).

The flame resistances of the paper sheets (A) and (B) were measured in accordance with JIS A 1322. The results are shown in Table 1.

TABLE 1

| | Item | | | | |
|---|---|---|---|---|---|
| | | | Burning test | | |
| Example No. | Type of paper sheet | Amount of $Al(OH)_3$ (%) | Carbonization length (cm) | After-flaming (sec) | After-glow (sec) |
| Example 2 | (A) | 32 | 8 | 1 | 11 |
| Comparative Example 1 | (B) | 32 | Immediately ignited and burnt | | |

Table 1 clearly shows that the modified pulp paper sheet of Example 2 exhibited a satisfactory flame resistance, whereas the non-modified pulp paper sheet of Comparative Example 1, in which aluminum hydroxide in the same amount as in Example 2 was mixed with the non-modified pulp fibers, exhibited substantially no flame resistance.

Example 3

The same procedures as in Example 1 were carried out, with the following exceptions.

In the immersing step, the aqueous solution contained sodium silicate in a Baume degree of 40.

After the centrifugalizing step, the amount of the aqueous solution of sodium silicate picked up by the pulp was 250% based on the dry weight of the pulp.

After the drying step, the resultant modified pulp had the same appearance as the non-modified pulp.

By the incineration test, it was confirmed that the modified pulp fibers carried therein a silicic acid gel in an amount of 49% based on the dry weight of the pulp.

Example 4 and Comparative Example 2

In Example 4, the same procedures as in Example 1 were carried out, with the following exceptions.

In the immersing step, 200 ml of an aqueous solution of 23% by weight of aluminum sulfate in an ion-exchanged water was used.

After the centrifugalizing step, the pulp was impregnated with the alminum sulfate aqueous solution in an amount of 300% based on the dry weight of the pulp.

The impregnated pulp was placed in a pressure container and the container was closed and filled with an ammonia gas under a pressure of 0.5 kg/cm$^2$ G. The impregnated pulp was treated with the ammonia for 60 minutes. After the ammonia gas was discharged, the resultant modified pulp was removed from the container, and treated and dried in the same manner as in Example.

The resultant modified pulp had the same appearance as the non-modified pulp, and was composed of individual pulp fibers which were separated from each other.

As a result of the incineration test at 900° C., it was confirmed that the resultant modified pulp carried therein aluminum hydroxide in an amount of 40.4% based on the dry weight of the pulp.

The modified pulp was converted to a paper sheet (C) having a basis weight of 100 g/m$^2$.

In Comparative Example 2, a paper sheet (D) having the same basis weight as in Example 4 was produced from an aqueous slurry of a mixture of the non-modified pulp and aluminum hydroxide dispersed altogether in water.

The paper sheets (C) and (D) were subjected to the same burning test (JIS A 1322) as in Example 2. The results are shown in Table 2.

TABLE 2

| | Item | | | | |
|---|---|---|---|---|---|
| | | | Burning test | | |
| Example No. | Type of paper sheet | Amount of $Al(OH)_3$ (%) | Carbonization length (cm) | After-flaming (sec) | After-glow (sec) |
| Example 4 | (C) | 40.4 | 8 | 1 | 11 |
| | (D) | 40.4 | Immediately ignited and burnt | | |

Example 5

The same procedures as in Example 2 were carried out with the following exceptions.

In the immersing step, the aqueous solution contained 20% by weight of magnesium nitrate.

The centrifugalizing step was carried out at an acceleration of gravity of 1500 g for 15 minutes. The resultant impregnated pulp contained the magnesium nitrate aqueous solution in an amount of 230% based on the dry weight of the pulp.

The carbon dioxide gas was replaced by an ammonia gas.

By the incineration test at 900° C., it was conformed that the resultant modified pulp carried therein magnesium hydroxide in an amount of 32% based on the dry weight of the pulp.

Example 6

The same procedures as in Example 4 were carried out, with the following exceptions.

The pulp impregnated with 300% by weight of the aluminum sulfate aqueous solution was opened in the ambient air atmosphere by using a mixer, and immersed in a 10% ammonia aqueous solution for 60 minutes.

Thereafter, the resultant modified pulp was removed from the ammonia aqueous solution, immersed in one liter of ion-exchanged water at room temperature for one hour, disintegrated in water by using a disintegrator, washed with water on a 150 mesh wire net, and dried.

The resultant washed pulp had the same appearance as the non-modified pulp and was composed of individual pulp fibers which were separated from each other.

As a result of the incineration test at 900° C., it was confirmed that the resultant modified pulp carried therein aluminum hydroxide in an amount of 11%, based on the dry weight of the pulp.

The modified pulp could be converted to a paper sheet by a customary paper-forming process, without difficulty, and the resultant paper sheet exhibited an excellent flame resistance.

Example 7

The same procedures as in Example 5 were carried out, with the following exceptions.

The magnesium nitrate was replaced by calcium chloride.

The pulp impregnated with the calcium chloride aqueous solution, in an amount of 230% based on the dry weight of the pulp, was immersed in an aqueous solution of 20% by weight of sodium carbonate at room temperature for 60 minutes, removed from the solution, immersed in one liter of an ion-exchanged water for one hour, disintegrated in water by using a disintegrator, washed with water on a 150 mesh wire net, and dried.

As a result of a incineration test at 900° C., it was confirmed that the modified pulp carried therein calcium carbonate in an amount of 32%, based on the dry weight of the pulp.

The modified pulp exhibited an enhanced light-scattering coefficiency compared with the non-modified pulp, and was useful for forming a paper sheet having a high opacity.

I claim:

1. A process for modifying hydrophilic fibers with a substantially water-insoluble inorganic substance, comprising the steps of:

immersing hydrophilic fibers in an aqueous solution comprising 6 to 60% by weight of a water-soluble inorganic compound (a) which is converted to a substantially water-insoluble inorganic compound when brought into contact with a precipitant (b);

adjusting the amount of the water-soluble inorganic compound (a) aqueous solution impregnated in the hydrophilic fibers to a level of 60 to 400% based on the dry weight of the hydrophilic fibers; and bringing the impregnated hydrophilic fibers into contact with the precipitant (b) in the state of a gas, to cause the resultant substantially water-insoluble inorganic compound to be precipitated in and fixed to the hydrophilic fibers.

2. The process as claimed in claim 1, wherein the hydrophilic fibers are selected from at least one member of the group consisting of polyvinylalcohol fibers, polyacrylamide fibers and lignocellulosic fibers.

3. The process as claimed in claim 2, wherein the cellulosic fibers are pulp fibers.

4. The process as claimed in claim 1, wherein the water-soluble inorganic compound (a) is selected from the group consisting of aluminates, silicates and zincates of alkali metals, and the gaseous precipitant (b) comprises at least one acidic compound selected from the group consisting of carbon dioxide and hydrogen chloride.

5. The process as claimed in claim 1, wherein the water-soluble inorganic compound (a) is selected from the group consisting of silver nitrate, lead nitrate, and mercurous nitrate, and the gaseous precipitant (b) comprises a halogen.

6. The process as claimed in claim 1, wherein the water-soluble inorganic compound (a) is selected from the group consisting of silver nitrate, lead nitrate, copper sulfate, mercurous nitrate and tin (II or IV) nitrate and the gaseous precipitant (b) comprises hydrogen sulfide.

7. The process as claimed in claim 1, wherein the water-soluble inorganic compound (a) is selected from the group consisting of water-soluble salts of aluminum, chromium (III), zinc, manganese, iron (II or III), nickel and cobalt, and the gaseous precipitant (b) comprises hydrogen sulfide.

8. The process as claimed in claim 1, wherein the aqueous solution of the water-soluble inorganic compound (a) contains at least one water-soluble salt of an alkaline earth metal together with either ammonia or an alkali metal carbonate, and the gaseous precipitant (B) comprises carbon dioxide.

9. The process as claimed in claim 1, wherein the water-soluble inorganic compound (a) is a water-soluble salt of a metallic element other than an alkali metal, and the precipitant (b) comprises ammonia in the state of a gas.

10. The process as claimed in claim 9, wherein said water soluble salt is selected from the group consisting of water-soluble nitrates, chlorides, and sulfates of silver, zinc, aluminum, cobalt, zirconium, tin, titanium, iron, copper, lead, magnesium, cadmium, mercury, and chromium.

11. The process as claimed in claim 1, wherein the hydrophilic fibers impregnated with the aqueous solution of the water-soluble inorganic compound (a) are opened in the ambient air atmosphere before being brought into contact with the gaseous precipitant (b).

12. The process as claimed in claim 1, wherein the gaseous precipitant (b) is diluted by a gas non-reactive to the water-soluble inorganic compound (a).

* * * * *